US010399214B2

(12) United States Patent
Winnard

(10) Patent No.: US 10,399,214 B2
(45) Date of Patent: Sep. 3, 2019

(54) RATCHET WRENCH

(71) Applicant: Stanley D. Winnard, Dallas, TX (US)

(72) Inventor: Stanley D. Winnard, Dallas, TX (US)

( * ) Notice: Subject to any disclaimer, the term of this patent is extended or adjusted under 35 U.S.C. 154(b) by 174 days.

(21) Appl. No.: 14/574,000

(22) Filed: Dec. 17, 2014

(65) Prior Publication Data

US 2016/0176024 A1 Jun. 23, 2016

(51) Int. Cl.
*B25B 13/46* (2006.01)
*B25B 13/48* (2006.01)

(52) U.S. Cl.
CPC ..... *B25B 13/467* (2013.01); *B25B 13/463* (2013.01); *B25B 13/481* (2013.01)

(58) Field of Classification Search
CPC .... B25B 13/463; B25B 13/467; B25B 13/481
USPC ..... 81/57.29, 57.39
See application file for complete search history.

(56) References Cited

U.S. PATENT DOCUMENTS 119,317 A * 9/1871 Chandler ..... B25B 13/463 81/61
1,121,668 A * 12/1914 Rusk et al. ..... B25B 17/00 105/307
1,543,338 A * 6/1925 Neat et al. ..... B25B 13/467 74/156
1,708,147 A * 4/1929 Miller ..... B25B 13/488 81/13
1,970,721 A * 8/1934 Walton ..... B25B 13/467 74/142
2,542,015 A * 2/1951 Ellison ..... B25B 13/467 74/143
2,634,630 A 4/1953 Johnson
2,831,384 A * 4/1958 Weiss ..... B25B 13/467 81/57.13

(Continued)

FOREIGN PATENT DOCUMENTS

CN 2442857 Y 8/2001
CN 201455880 5/2010

(Continued)

OTHER PUBLICATIONS

PCT/US2016/034169, International Search Report and Written Opinion, dated Feb. 8, 2017, 11 pages.

*Primary Examiner* — Hadi Shakeri
(74) *Attorney, Agent, or Firm* — Peter V. Schoeder

(57) ABSTRACT

A ratchet wrench comprising a housing, at least one gear supported within the housing, one of the at least one gear comprising a drive hole, a stationary handle extending from the housing, a dynamic handle hingedly extending from the housing such that, the dynamic handle is rotatable between at least one handle open position and a handle closed position, and at least one pawl, each of the at least one pawl adapted to slide between a pawl open position and a pawl closed position, one of the at least one pawl adapted to be in engagement with one of the at least one gear at a time. The dynamic handle disposed in operative communication with the at least one pawl such that, rotating the dynamic handle towards the handle closed position causes the at least one gear rotate in one direction and releasing the dynamic handle causes pawl to return to the pawl open position without causing the at least one gear to rotate in the opposite direction.

16 Claims, 13 Drawing Sheets

(56) References Cited

U.S. PATENT DOCUMENTS

| | | | | |
|---|---|---|---|---|
| 2,972,919 | A * | 2/1961 | Stalkup | B25B 13/463 81/63 |
| 3,941,017 | A | 3/1976 | Lenker et al. | |
| 3,970,151 | A | 7/1976 | Workman | |
| 4,082,475 | A | 4/1978 | Kuder | |
| 4,114,663 | A | 9/1978 | Viner | |
| 4,154,122 | A * | 5/1979 | Severin | B25B 13/46 408/126 |
| 4,475,420 | A | 10/1984 | Atkinson et al. | |
| 4,541,160 | A | 9/1985 | Roberts | |
| 4,703,676 | A | 11/1987 | Mayer | |
| 4,856,385 | A * | 8/1989 | Ogilvie | B25B 17/00 81/57.39 |
| 4,898,249 | A | 2/1990 | Ohmori | |
| 5,216,897 | A | 6/1993 | Tsuchiyama | |
| 5,363,726 | A | 11/1994 | Smith | |
| 5,730,232 | A | 3/1998 | Mixer | |
| 5,897,454 | A | 4/1999 | Cannaliato | |
| 5,993,454 | A | 11/1999 | Longo | |
| 6,035,515 | A | 3/2000 | Baer et al. | |
| 6,352,127 | B1 | 3/2002 | Yorde | |
| 6,435,285 | B1 | 8/2002 | Tsai | |
| 6,463,824 | B1 | 10/2002 | Prell et al. | |
| 6,481,105 | B1 * | 11/2002 | Haung | B23D 21/06 30/101 |
| 6,510,903 | B2 | 1/2003 | Funfer | |
| 6,676,558 | B2 | 1/2004 | Futterer | |
| 6,722,232 | B1 | 4/2004 | Day | |
| 6,810,773 | B2 * | 11/2004 | Trucchio | B25B 13/08 81/13 |
| 7,191,677 | B2 | 3/2007 | Barkdoll | |
| 7,299,720 | B1 | 11/2007 | Schultz et al. | |
| 7,410,007 | B2 | 8/2008 | Chung et al. | |
| 7,770,494 | B2 | 8/2010 | Cornwell et al. | |
| 7,841,329 | B2 | 11/2010 | Yang | |
| 7,980,324 | B2 | 7/2011 | Bixler et al. | |
| 3,381,831 | A1 | 2/2013 | Sekino et al. | |
| 8,371,394 | B2 | 2/2013 | Grand | |
| 8,381,834 | B2 | 2/2013 | Barhitte et al. | |
| 8,820,431 | B2 | 9/2014 | Puzio et al. | |
| 8,985,240 | B2 | 3/2015 | Winnard | |
| 9,199,359 | B2 | 12/2015 | Marks | |
| 9,561,549 | B2 | 2/2017 | Fraese et al. | |
| 9,566,692 | B2 | 2/2017 | Seith et al. | |
| 2002/0037785 | A1 | 3/2002 | Wissmach et al. | |
| 2004/0031358 | A1 | 2/2004 | Badiali | |
| 2004/0118253 | A1 | 6/2004 | Trucchio | |
| 2006/0237205 | A1 | 10/2006 | Sia et al. | |
| 2007/0068693 | A1 | 3/2007 | Whitmire et al. | |
| 2007/0282344 | A1 | 12/2007 | Yedlicka et al. | |
| 2009/0003950 | A1 | 1/2009 | Mok et al. | |
| 2009/0084230 | A1 * | 4/2009 | Selgas | B25B 13/467 81/467 |
| 2009/0260487 | A1 | 10/2009 | Wang | |
| 2010/0186978 | A1 | 7/2010 | Sekino et al. | |
| 2010/0200257 | A1 | 8/2010 | Scrimshaw et al. | |
| 2011/0005358 | A1 | 1/2011 | Sun | |
| 2011/0232930 | A1 | 9/2011 | Zhang et al. | |
| 2012/0255751 | A1 | 10/2012 | Lee et al. | |
| 2014/0051539 | A1 | 2/2014 | Roehm et al. | |

FOREIGN PATENT DOCUMENTS

| | | |
|---|---|---|
| CN | 101987441 A | 3/2011 |
| FR | 2278505 A2 | 2/1976 |
| KR | 200418536 Y1 | 6/2006 |
| TW | M267030 | 6/2005 |
| TW | M311531 | 5/2007 |

* cited by examiner

RATCHET WRENCH

BACKGROUND

Field of the Invention

The present invention relates to mechanical tools and implements, and more particularly, to an improved ratchet wrench that negates the need for the user to physically rotate the wrench once the wrench is engaged to a rotary fastener such as, a nut or a bolt, so as to fasten or unfasten the same.

A conventional ratchet wrench, as well known in the art, improves over a simple wrench in a way that a user is no longer needed to disengage the drive or grip hole of the wrench from the rotary fastener (such as, a nut, a bolt, or the like) when tightening or loosening the same. In other words, rotating the ratchet wrench opposite to the intended direction (for fastening or unfastening) while engaged to the fastener doesn't result in the fastener being rotated in the non-intended direction owing to the arrangement of the gear and the pawl that meshes with the gear in only one direction of the rotation of the gear. Although, a ratchet wrench greatly eases the operation, it must be acknowledged that a conventional ratchet wrench still needs to be manually rotated in clockwise and counter-clockwise directions in order to get the fastening done. This could be an issue when using the ratchet wrench in tighter spaces, where manual rotation is limited. All in all, with all the technological advancement at one's disposal, a ratchet wrench that betters a conventional ratchet wrench by negating the need for the user to manually rotate the wrench to and fro would be a welcome product in the art.

SUMMARY

The present invention comprises an improved ratchet wrench that performs fastening and unfastening of rotary fasteners (such as, a bolt, a nut, etc.) while keeping the ratchet wrench stationary. The ratchet wrench comprises three gears, viz., a first gear, a second compound gear, and a drive gear wherein, the first gear meshes with the second gear and the second gear meshes with the drive gear, which comprises a drive hole for receiving the head of a rotary fastener.

The ratchet wrench further comprises a slidable pawl that is adapted to engage the first gear in one direction towards a pawl closed position so as to rotate the first gear and thereby the drive hole. The pawl, when slid in the opposite direction (to the pawl closed position) towards a pawl open position, disengagingly slides against the teeth of the first gear whereby, first gear and consequentially the drive hole remains stationary. The pawl is driven by a dynamic handle towards the pawl closed position whereby, the user, by simply operating the dynamic handle can effect the rotation of the drive. Releasing the dynamic handle causes the pawl to fall back to the pawl closed position.

Other objects and advantages of the embodiments herein will become readily apparent from the following detailed description taken in conjunction with the accompanying drawings.

FIGURES—REFERENCE NUMERALS

10—Ratchet Wrench
12—Housing
14—Drive Hole
16—Stationary Handle
18—Dynamic Handle
20—Side Wall
22—Circumferential Wall
24—Opening
26—Slide Track
28—Engagement Track
30—Disengagement Track
32—Distal Boundary
34—Transition Slope
36—Proximal Boundary
38—Stationary Bar
40—First Gear
42—Second Gear
44—Drive Gear
46—Smaller Gear
48—Larger Gear

50—Pawl
52—Projection Member
54—Hollow Section
56—Dynamic Bar
58—Bias Spring
60—Bias Rod

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The present invention comprises an improved ratcheting wrench or, simply ratchet wrench that negates the need for the user to manually rotate the handle of the ratchet wrench (when engaged with a rotary fastener, such as, a nut, bolt, etc.) in order to fasten or unfasten the rotary fastener.

Figure 1:
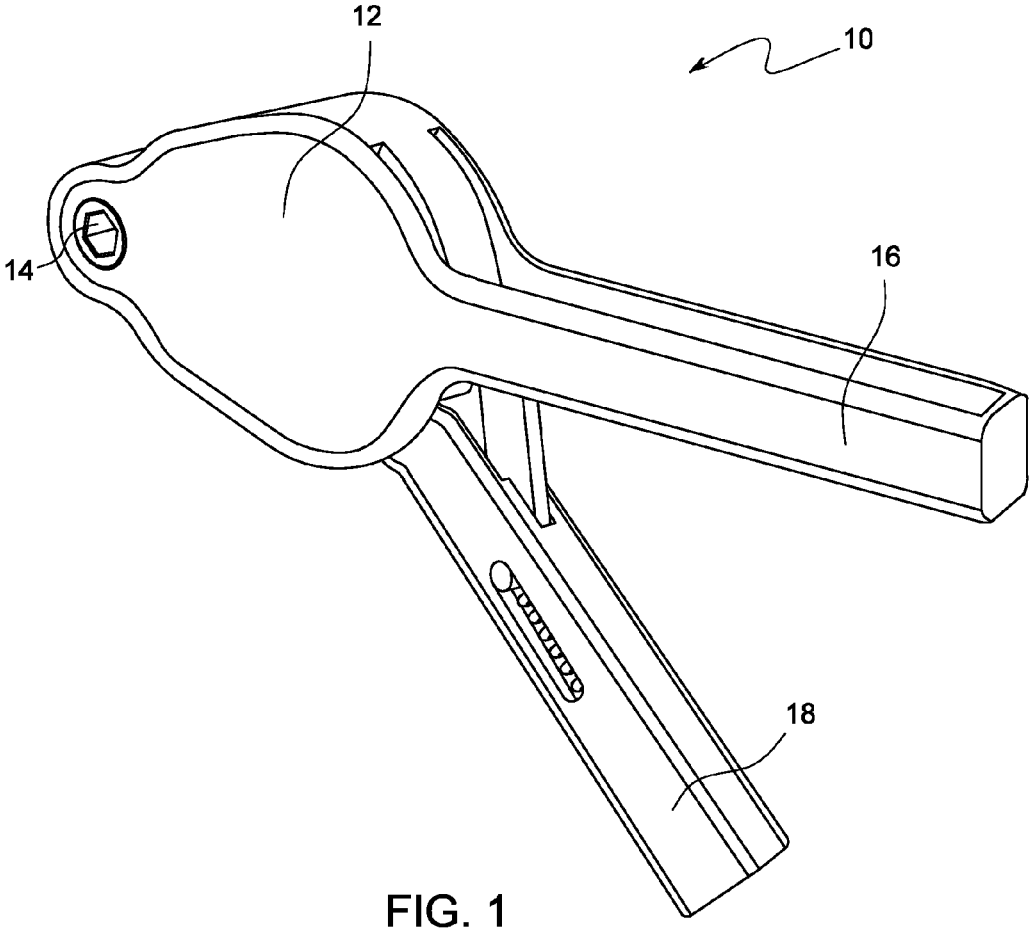
FIG. 1, according to an embodiment of the present invention, is an illustration of a perspective view of the ratchet wrench.
Figure 2:
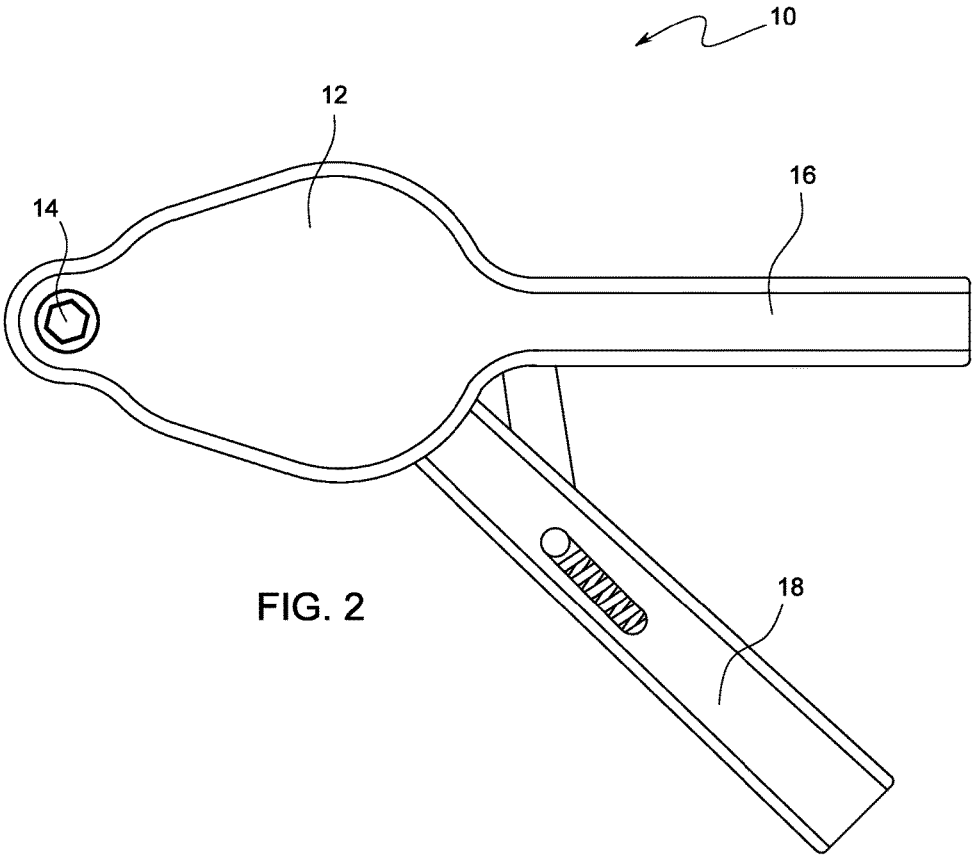
FIG. 2, according to an embodiment of the present invention, is an illustration of a plan view of the ratchet wrench.

Referring to FIGS. 1 and 2, the ratchet wrench 10 comprises a housing 12, a drive hole 14 (or alternatively, a drive head) accessible through the housing 10, and a pair of elongate handles viz., a stationary handle 16 and a dynamic handle 18 extending from the housing 10. As can be appreciated from FIG. 2, squeezing the dynamic handle 18 against the stationary handle 16 causes the drive hole 14 to rotate. Upon releasing the dynamic handle 18, the dynamic handle 18 returns to the former position by causing the 'ratcheting effect', as a result of which, the drive hole 14 remains stationary. The other components of the wrench 10 and the mutual operative communication therebetween will become apparent from the following body of text.

Referring to FIGS. 3 through 7, the housing 12 comprises a pair of flat side walls 20, each of which defined by a curved circumferential edge, and a circumferential wall 22 extending perpendicularly between the curved edges. While the circumferential wall 22 extends integrally from one side wall 20, the other side wall 20 may either be removably snap-fitted or fastened to the circumferential wall 22 so as to access the internal components within the housing 10 for maintenance or repairing purposes. The housing 12 further comprises a pair of opposingly-disposed flat, planar layer members (not shown), which are disposed parallel to the side walls 20. Each layer member comprises a thorough arc-shaped slide track disposed thereon wherein, the utility of the slide track will become apparent from the following body of text. Further, a portion of the opposingly-disposed top and bottom edges of a proximal portion of circumferential wall are cut off to form arc-shaped openings 24 wherein, the utility of the arc-shaped openings will be discussed in the following body of text.

Figure 8:
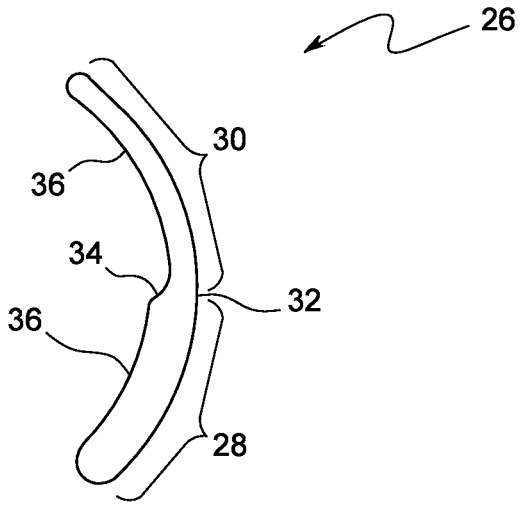
FIG. 8, according to an embodiment of the present invention, is an illustration of a plan view of the slide track.

Referring to FIG. 8, each slide track 26 is divided into a wider engagement track 28 and a narrower disengagement track 30 extending integrally from one extremity of the engagement track 28. As can appreciated from the referred drawings, the engagement and the disengagement tracks 28 and 30 share a common arc-shaped distal boundary 32 while a smooth, shallow transition slope 34 serves as a transition between the arc-shaped proximal boundaries 36 thereof. While the curvature-based orientation (concave vs. convex) of both the slider tracks 26 remains the same, the directions of the slider tracks 26 are reversed. More particularly, while one the slider track 26 proceeds from the engagement to the disengagement tracks 28 and 30 clockwise, the other slider track 26 proceeds from the disengagement to the engagement tracks 30 and 28 clockwise.

Figure 9:
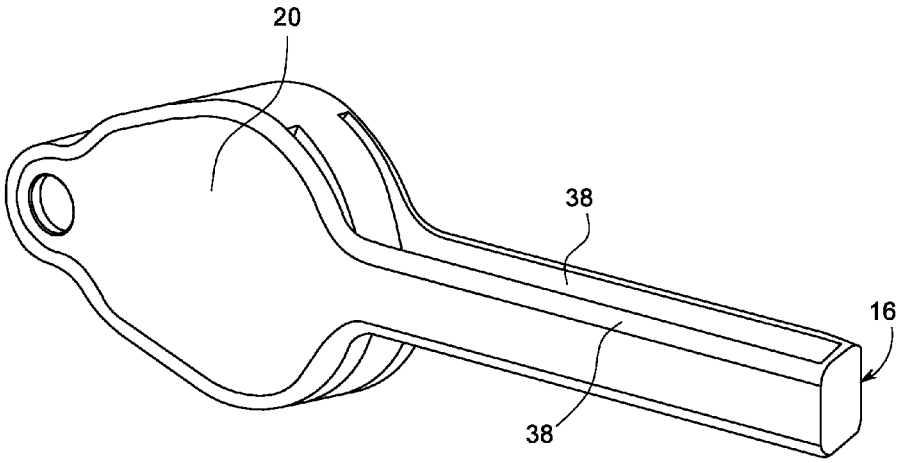
FIG. 9, according to an embodiment of the present invention, is an illustration of a perspective view of the housing with the stationary handle.
Figure 10:
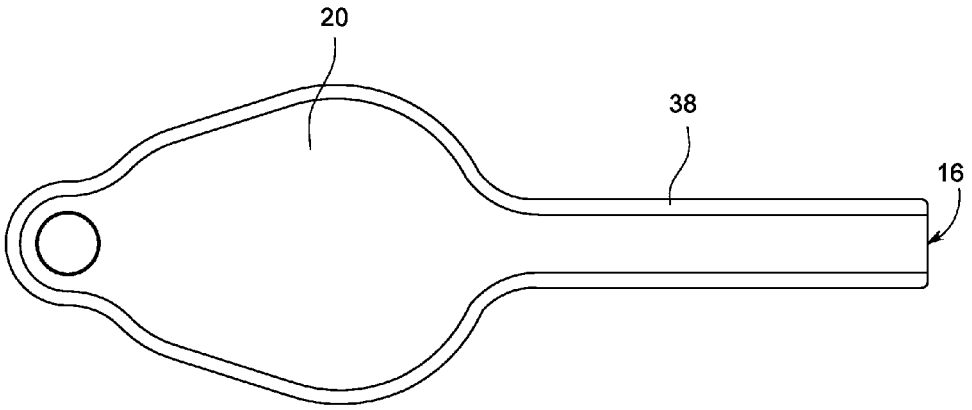
FIG. 10, according to an embodiment of the present invention, is an illustration of a plan view of the housing with the stationary handle.
Figure 11:
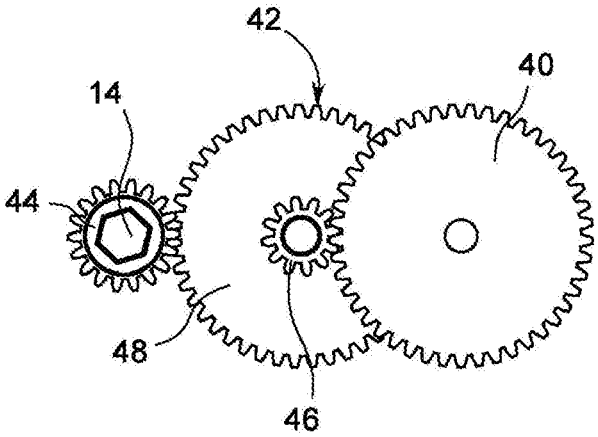
FIG. 11, according to an embodiment of the present invention, is an illustration of a plan view of the arrangement of the gears.
Figure 12:
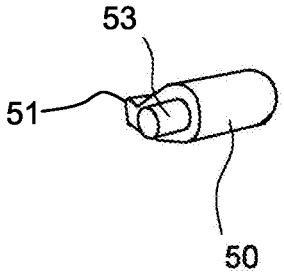
FIG. 12, according to an embodiment of the present invention, is an illustration of a perspective view of a pawl.

Referring to FIGS. 9 and 10, a substantially flat elongate stationary bar 38 integrally extends from a proximal edge of each side wall 20. The free ends of the stationary bars 38 are integrally joined together wherein, the pair of stationary bars 38 together makes up the aforementioned stationary handle 16. In one embodiment, the lateral edges of each stationary bar comprise a series of alternative crests and troughs for ergonomic reasons.

Referring to FIGS. 3 through 5, and 11, the wrench 10 further comprises three gears supported within housing 12 and each of which disposed parallel to the pair of side walls 20. The three gears comprise a first gear 40, a second gear 42, and a drive gear 44, wherein, the first gear 40 meshes with the second gear 42 and the second gear 42, in turn, meshes with the drive gear 44.

The second gear 42 comprises a compound gear wherein, more particularly, the first gear 40 meshes with the smaller gear 46, while the drive gear 44 meshes with the larger gear 48. Notably, the gear shafts of the first and second gears 40 and 42 extend through the layer members as the gear shafts are supported between the pair of side walls 20. The drive gear 44 comprises the drive hole 14, the either sides of which accessible through the side walls. In one embodiment, a drive head may be employed in lieu of the drive hole 14. Notably, the drive gear 44 is wider (or thicker) than the first and the second gears 40 and 42.

Referring to FIGS. 3 through 5, 12 and 16 through 18, the wrench 10 further comprises two opposingly-disposed pawls 50. A first and a second pawl are mounted to the dynamic handle 18 at their pawl shafts 53, as seen in FIGS. 3-4 and 16-18. Each pawl 50 is adapted to engage the first gear 40 in one direction and ratchet in the opposite direction. More particularly, the pawls 50 are configured such that, if the first pawl 50 engages first gear 40 when moving in the clockwise direction, the second pawl 50 engages the first gear 40 when moving in the counter-clockwise direction. Particularly, as can be appreciated from FIGS. 3-4 and 16-18, each pawl 50 comprises an elongate cylindrical projection member 52 extending laterally therefrom wherein the projection member 52 is adapted to be slidably received within the slide track 26. Each projection member 52 is adapted to be loosely received within the engagement track 28, while snugly received within the disengagement track 30. Each pawl 50 is adapted to be snugly and slidably disposed between the pair of layer members as the corresponding projection member 52 is slidably received within the corresponding slide track 26. The wrench 10 is configured such that each pawl 50, when its projection member 52 is in the engagement track 28, engages the first gear 40 and, when its projection member 52 is in the disengagement track 30, disengages the first gear. More particularly, the narrower disengagement track 30 (FIG. 8) forces the projection member 52 of the pawl and the pawl tooth 51 away from the first gear 40 and precludes the angular movement of the pawl 50 towards the first gear 40 thereby keeping the pawl 50 disengaged from the first gear 40.

Figure 13:
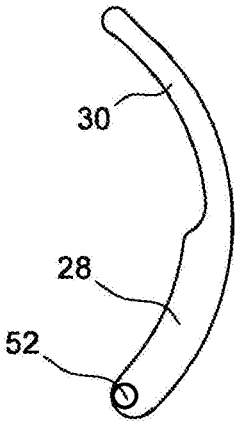
FIG. 13, according to an embodiment of the present invention, is an illustration of a pawl being at pawl open position with respect to the corresponding slide track.
Figure 14:
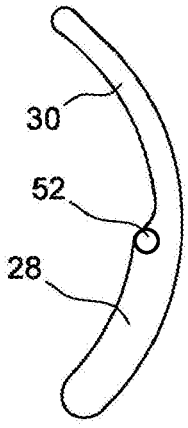
FIG. 14, according to an embodiment of the present invention, is an illustration of a pawl being at pawl closed position with respect to the corresponding slide track.
Figure 15:
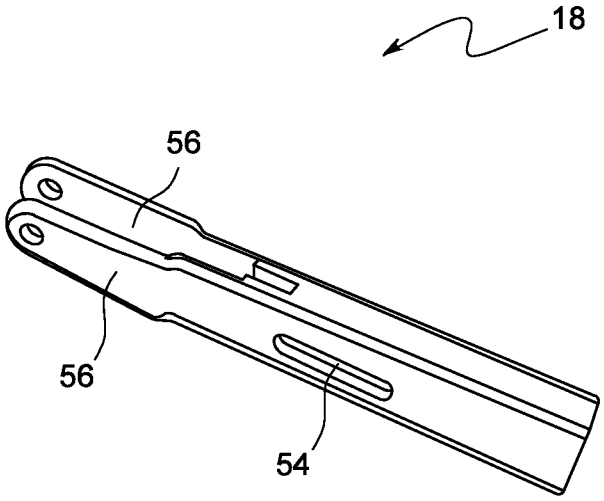
FIG. 15, according to an embodiment of the present invention, is an illustration of a perspective view of the dynamic handle.

Referring to FIGS. 3 through 5, 8, and 12 through 14, notably, within the engagement track 28, each pawl 50 is slidably movable between a pawl open position and a pawl closed position wherein, in the pawl open position, the projection member 52 is at an extremity of the engagement track 28 which is farthest from the point of entry of the disengagement track 30 (ref. FIG. 13) and wherein, in the pawl closed position, the projection member 52 is at an extremity of the engagement track 28 which is nearest to the point of entry of the disengagement track 30 (ref. FIG. 14).

Figure 16:
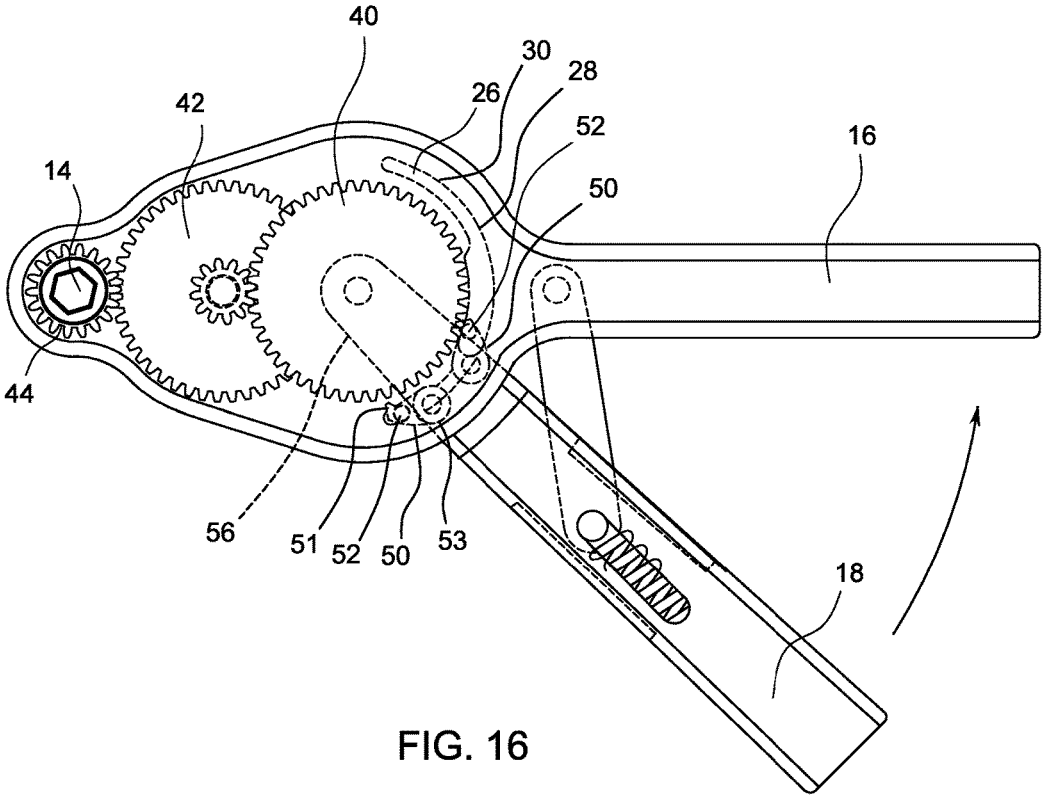
FIGS. 16 through 18, according to an embodiment of the present invention, are sequential illustrations of the dynamic handle at the first handle open position, handle closed position, and the second handle open position.
Figure 17:
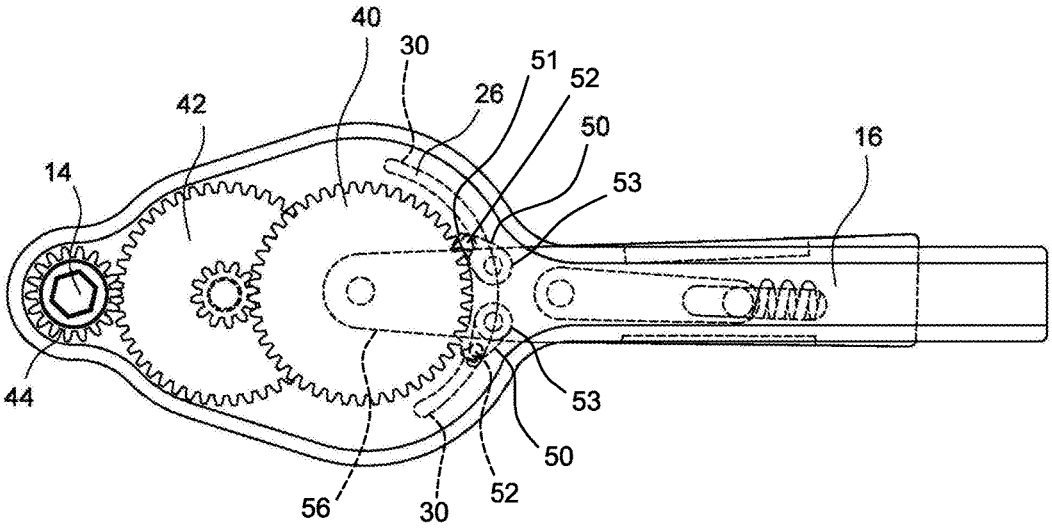
Figure 18:
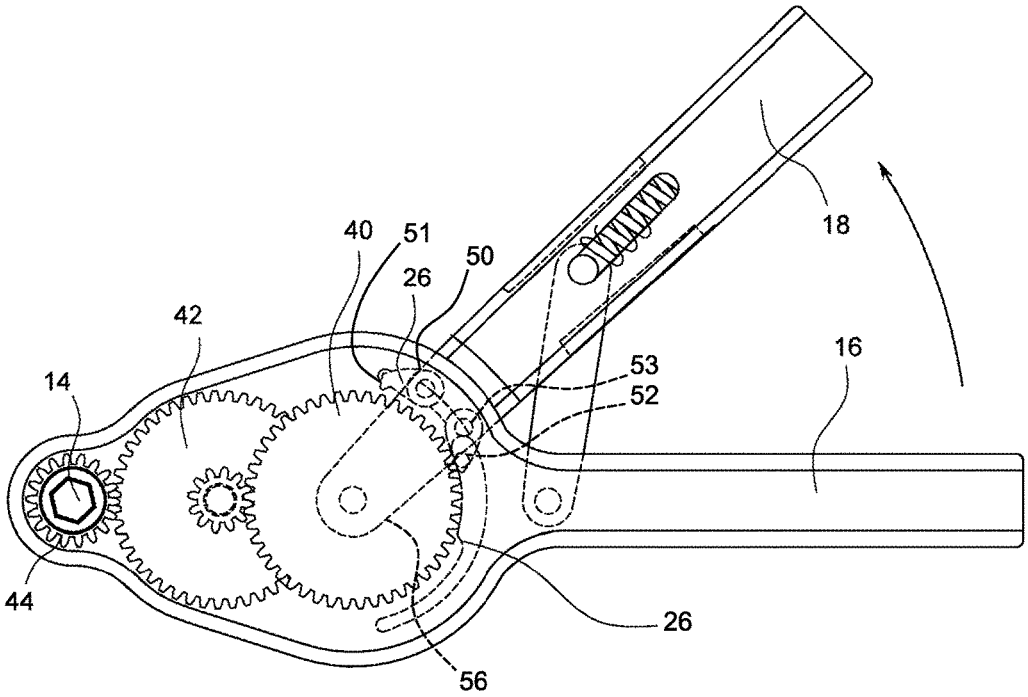

Referring to FIGS. 3 through 5, and 15 through 18, the dynamic handle 18 comprises elongate hollow section 54 and a pair of opposingly-disposed, parallel, elongate, substantially flat dynamic bars 56 integrally extending from an extremity of the hollow section 54. The hollow section 54 comprises a cylindrical chamber disposed therewithin wherein, the chamber is adapted to snugly receive a helical compression bias spring 58 therewithin. The free ends of the dynamic bars 56 are adapted to be hingedly secured to the gear shaft of the first gear 40 such that, the first gear 40 and the pair of layer members are disposed between the dynamic bars 56. The dynamic bars 56 extend through the pair of openings 24 as the dynamic handle 18 hingedly extends from within the housing 12. The dynamic handle 18 is configured such that, each dynamic bar 56 abuts the free end portion of the projection member 52 projecting through the slide track 26 at any given time. The dynamic handle 18, about the gear shaft of the first gear 40, is rotably movable between a first handle open position (FIG. 16), which is at one extremity of the openings 24, a mid handle closed position (FIG. 17), which is between the stationary bars 38 of the stationary handle 16, and a second handle open position (FIG. 18), which is at another extremity of the openings 24. In other words, the handle closed position (FIG. 17) bifurcates the first and second handle open positions (FIG. 16 and FIG. 18).

Figure 3:
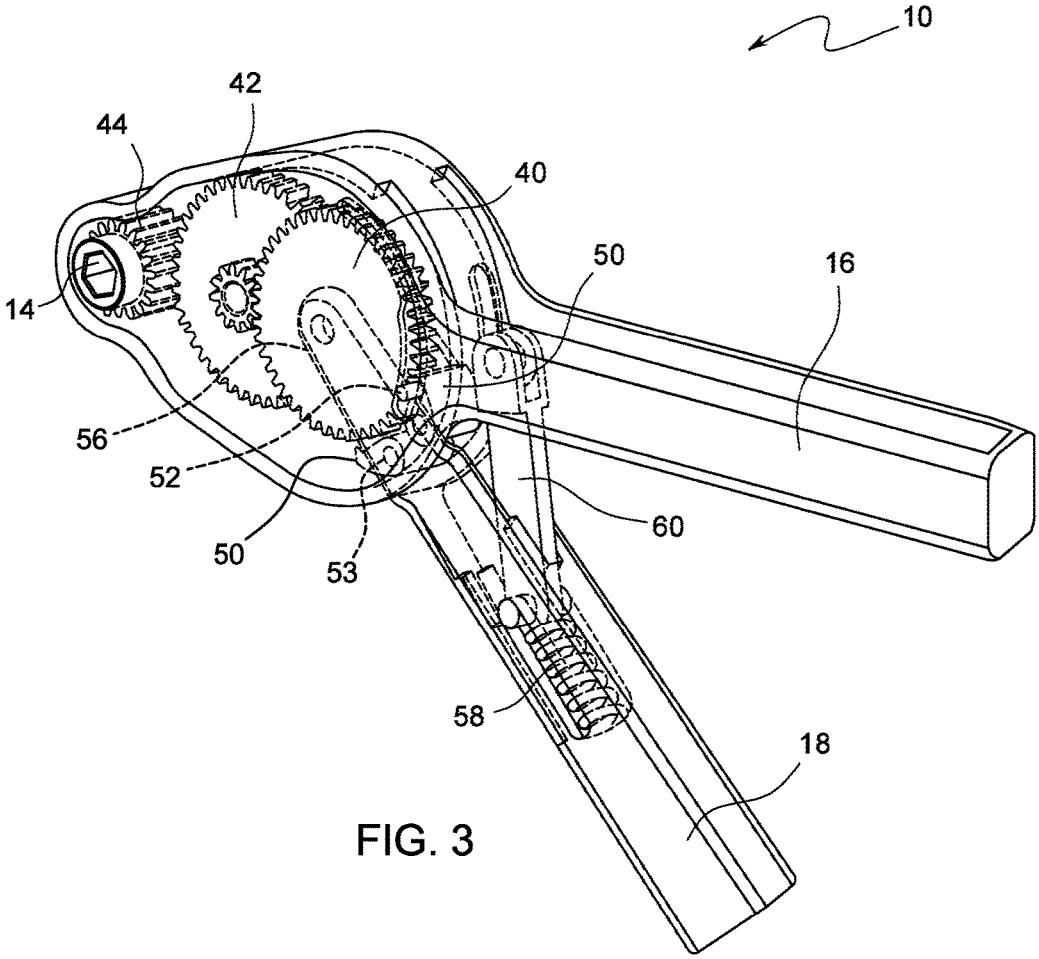
FIG. 3, according to an embodiment of the present invention, is an illustration of a perspective view of the ratchet wrench with the components therewithin being visible.
Figure 4:
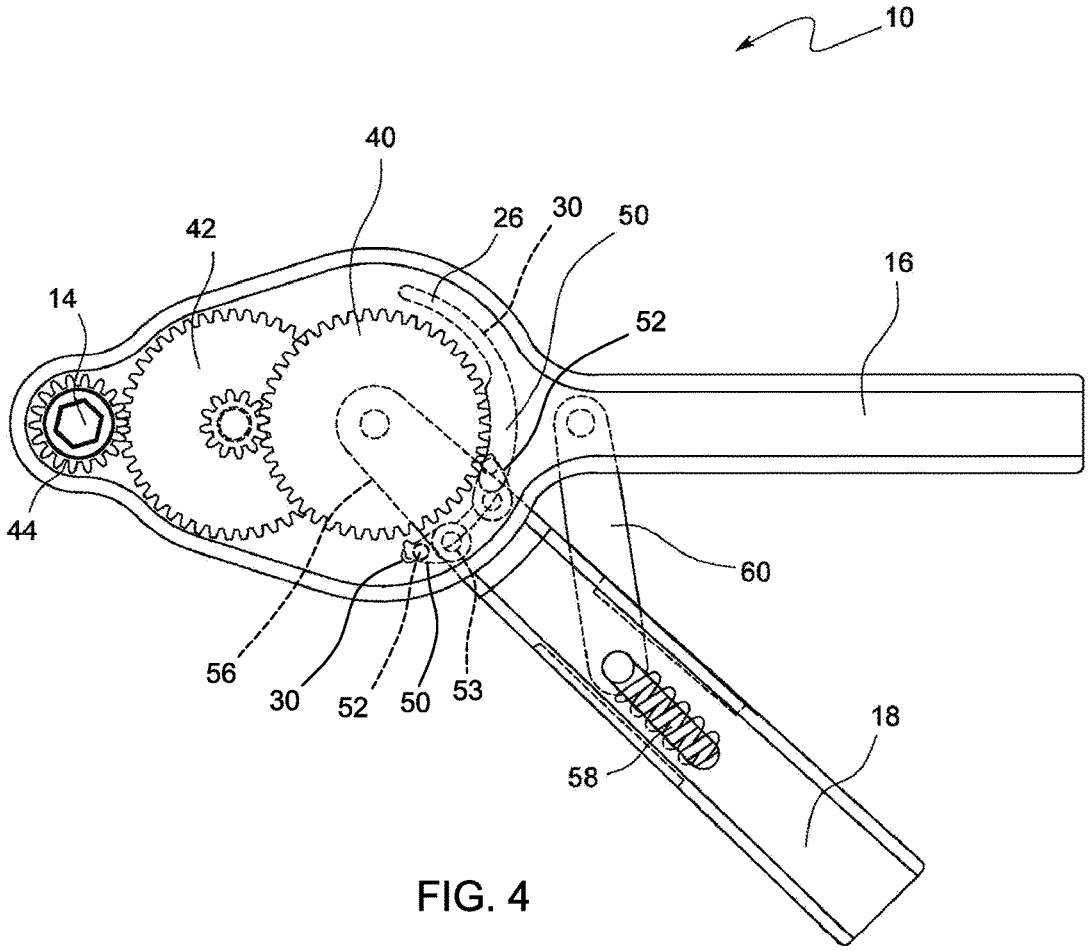
FIG. 4, according to an embodiment of the present invention, is an illustration of a plan view of the ratchet wrench with the components therewithin being visible.
Figure 5:
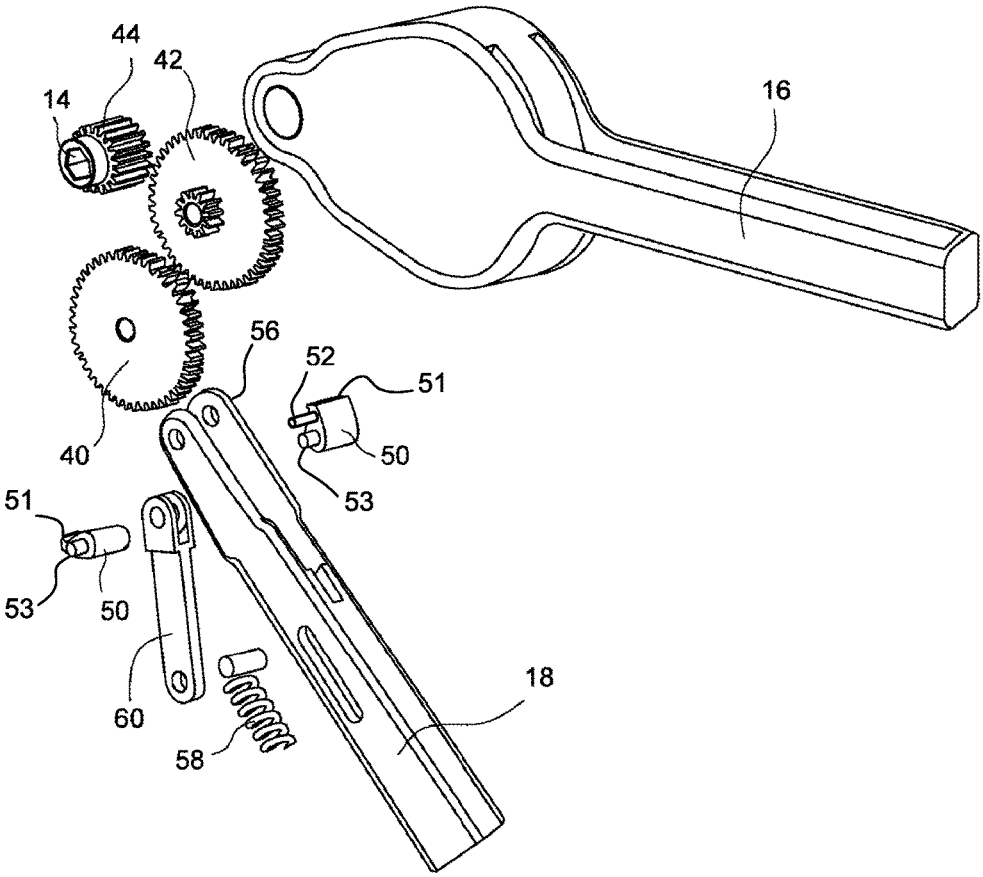
FIG. 5, according to an embodiment of the present invention, is an illustration of an exploded perspective view of the ratchet wrench.
Figure 6:
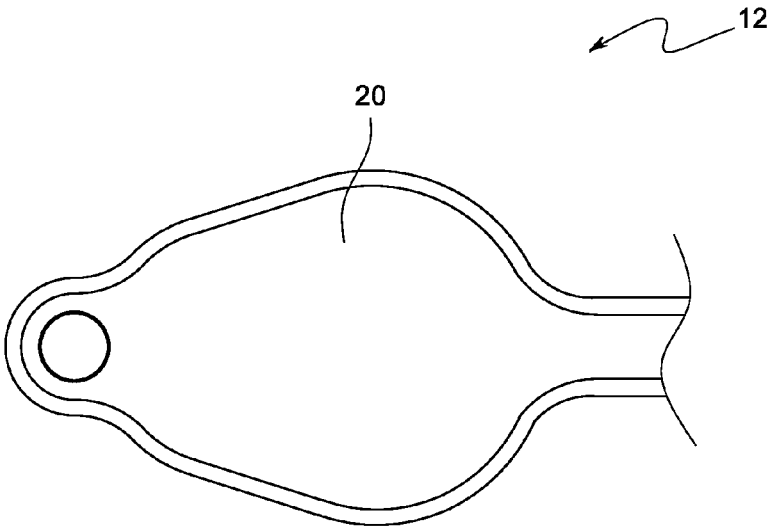
FIG. 6, according to an embodiment of the present invention, is an illustration of a plan view of the housing.
Figure 7:
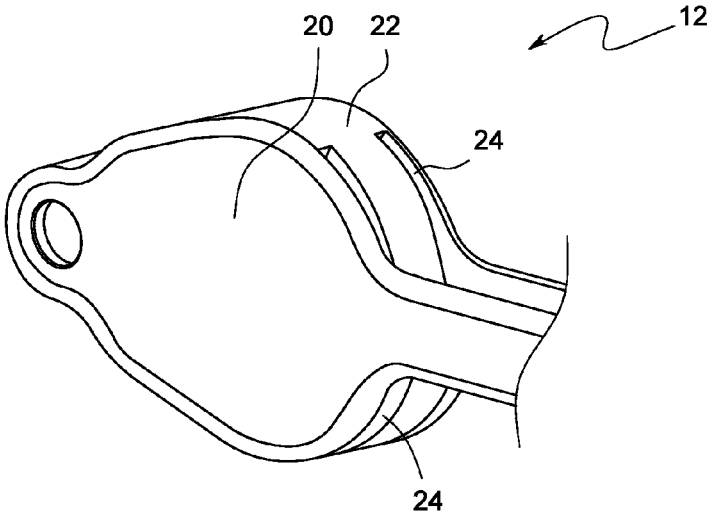
FIG. 7, according to an embodiment of the present invention, is an illustration of a perspective view of the housing.

Referring to FIGS. 3 through 5, the wrench 10 further comprises a bias rod 60 that hingedly extends from a portion of the circumferential wall 22 between the pair of stationary bars 38. The other extremity of the bias rod 60 is hingedly secured to an extremity of the bias spring 58 whereby, the dynamic handle 18 is biased towards either the first handle open position (FIG. 16) or the second handle open position (FIG. 18).

Referring to FIGS. 3 through 5, and 16 through 18, the pawls 50 and the dynamic handle 18 are arranged such that, when the dynamic handle 18 is at the first handle open position (FIG. 16), the projection member 52 of the first pawl 50 is disposed within the engagement track 28 (FIG. 8) of the slide track 26 and is engaging the first gear 40 while the projection member 52 of the oppositely-disposed second pawl 50 is disposed within the disengagement track 30 (FIG. 8) of the opposingly-disposed slide track 26. As the dynamic handle 18 is rotated from the first handle open position (FIG. 16) to the handle closed position (FIG. 17), the first pawl 50, as propelled by the dynamic handle 18 and owing to the engagement thereof to the first gear 40, rotates the first gear 40 causing the drive hole 14 to rotate-consequentially. Notably, as the dynamic handle 18 is rotated from the first handle open position (FIG. 16) to the handle closed position (FIG. 17), the projection member 52 of the second pawl 50 slides within an disengagement track 30 (FIG. 8). As the dynamic handle 18 is released, the dynamic handle 18 returns to the first handle open position (FIG. 16), which causes the first pawl 50 to slide towards the pawl open position (FIG. 13). Along the way, the tooth 51 of the first pawl 50, owing to the first pawl 50 being hinged to the handle 18, slides or ratchets against the teeth of the first gear 40 thereby not rotating the first gear 40, and consequentially not rotating the drive hole 14.

Referring to FIGS. 3 through 5, and 16 through 18, once the dynamic handle 18 is rotated to the second handle open position (FIG. 18) from the handle closed position (FIG. 17), the projection member 52 of the first pawl 50 is propelled by the bar 56 of dynamic handle 18 into a disengagement track 30 (FIG. 8) at which point, the projection member 52 of the second pawl 50 is simultaneously propelled into the engagement track 28 (FIG. 8) of the opposing slide track 26. Similar to what is discussed earlier, as the dynamic handle 18 is rotated from the second handle open position (FIG. 18) to the handle closed position (FIG. 17), the second pawl 50, as propelled by the dynamic handle 18, and owing to the engagement thereof to the first gear 40, rotates the first gear 40, causing the drive hole 14 to rotate consequentially, but now in the opposite direction. Notably, as the dynamic handle 18 is rotated from the second handle open position (FIG. 18) to the handle closed position (FIG. 17), the projection member 52 of the first pawl 50 slides within a disengagement track 30 (FIG. 8). As the dynamic handle 18 is released, the dynamic handle 18 returns to the second handle open position (FIG. 18), which causes the projection member 52 of the second pawl 50 to slide towards the pawl open position (FIG. 14). Along the way, the tooth 51 of the second pawl 50, owing to the second pawl 50 being hingedly attached to the handle 18, slides or ratchets against the teeth of the first gear 40, thereby not rotating the first gear 40 or the drive hole 14.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A ratchet wrench comprising:

a housing;

a first gear and a drive gear rotatably supported within the housing, the drive gear comprising either a drive hole or a drive head;

an elongated stationary handle fixedly extending from the housing;

an elongated dynamic handle hingedly extending from the housing and rotatable between a first open position on a first side of the stationary handle and a first closed position proximate and on the first side of the stationary handle, the dynamic handle biased towards the first open position when on the first side of the stationary handle; and the elongate dynamic handle movable to a second open position on a second side of the stationary handle, and rotatable between the second open position and a second closed position proximate and on the second side of the stationary handle, the dynamic handle biased towards the second open position when on the second side of the stationary handle;

a first pawl having a tooth in selective engagement with the first gear, the first pawl attached to and propelled by the dynamic handle as the dynamic handle is rotated towards the first closed position from the first open position, and wherein, as a result of the engagement between the first gear and the tooth of the first pawl, rotation of the dynamic handle towards the handle closed position causes the first gear to rotate which in turn causes the drive gear to rotate in a first direction and wherein release and rotation of the dynamic handle towards the first open position causes the first pawl to slide or ratchet against the first gear without causing the first gear to rotate;

a second pawl having a tooth in selective engagement with the first gear, the second pawl attached to and propelled by the dynamic handle as the dynamic handle is rotated towards the second closed position from the second open position, and wherein such rotation causes the first gear to rotate which in turn causes the drive gear to rotate in a second direction and wherein release and rotation of the dynamic handle from the second closed position towards the second open position causes the second pawl to slide or ratchet against the first gear without causing the first gear to rotate.

2. The wrench of claim 1 wherein, the housing comprises:

(a) a pair of opposingly-disposed side walls, the first gear supported on a first gear shaft extending between the side walls; and (b) the dynamic handle rotatable about the first gear shaft.

3. The wrench of claim 1 further comprising:

(a) a bias rod hingedly connected at opposite ends to the stationary handle and the dynamic handle; and (b) a bias spring secured at opposite ends to the bias rod and either the stationary or the dynamic handle.

4. The wrench of claim 1 further comprising a second gear, wherein the first gear meshes with the second gear and the second gear meshes with the drive gear.

5. The wrench of claim 4 wherein, the second gear comprises a compound gear having a smaller diameter gear which meshes with the first gear, and a larger diameter gear which meshes with the drive gear.

6. The wrench of claim 1 wherein the tooth of the first pawl is disengaged with the first gear when the tooth of the second pawl is engaged therewith.

7. A ratchet wrench comprising:

a housing;

a first gear and a drive gear rotatably supported within the housing, the drive gear comprising either a drive hole or a drive head;

an elongated stationary handle fixedly extending from the housing;

an elongated dynamic handle hingedly extending from the housing and rotatable between a first open position and a closed position, the dynamic handle biased towards the first open position;

a first pawl having a tooth in engagement with the first gear, the first pawl attached to and propelled by the dynamic handle as the dynamic handle is rotated towards the closed position from the first open position;

wherein, as a result of the engagement between the first gear and the tooth of the first pawl, rotation of the dynamic handle towards the handle closed position causes the first gear to rotate which in turn causes the drive gear to rotate in a first direction and wherein release and rotation of the dynamic handle towards the first open position causes the first pawl to slide or ratchet against the first gear without causing the first gear to rotate;

further comprising a second pawl attached to the dynamic handle and having a tooth for engaging the first gear as the second pawl is propelled by rotation of the dynamic handle towards the closed position from a second open position, the second open position of the dynamic handle on the opposite side of the stationary handle from the first open position;

wherein the tooth of the first pawl is disengaged with the first gear when the tooth of the second pawl is engaged therewith; and wherein the first pawl comprises a projection member extending laterally therefrom, the projection member of the first pawl slidably received within a first arcuate track defined by the housing and slidable between an engagement portion of the first arcuate track, wherein the tooth of the first pawl engages the first gear, and a disengagement portion of the first arcuate track, wherein the tooth of the first pawl is disengaged from the first gear; and wherein the second pawl comprises a projection member extending laterally therefrom, the projection member of the second pawl slidably received within a second arcuate track defined by the housing and slidable between an engagement portion of the second arcuate track, wherein the tooth of the second pawl engages the first gear, and a disengagement portion of the second arcuate track, wherein the tooth of the second pawl is disengaged from the first gear.

8. The wrench of claim 7 wherein the first and second arcuate tracks are opposingly-disposed and oriented with respect to one another such that when the projection of the first pawl is slidably received within the engagement portion of the first arcuate track, the projection of the second pawl is slidably received within the disengagement portion of the second arcuate track, and vice versa.

9. A ratchet wrench comprising:

(a) a housing;

(b) a first gear, a second gear, and a drive gear, the drive gear comprising either a drive hole or a drive head, the first gear meshing with the second gear and the second gear meshing with the drive gear;

(c) an elongated stationary handle fixedly extending from the housing;

(d) an elongated dynamic handle hingedly extending from the housing, the dynamic handle rotatable between a first open position on one side of the stationary handle, and a second open position on the opposite side of the stationary handle, the dynamic handle biased towards one of the-open positions at a time; and (e) a first and a second pawl attached to the dynamic handle and slidably engaging a first and second engagement track, respectively, defined in the housing, the engagement tracks forcing one of the two pawls into engagement with the first gear and the other of the two pawls out of engagement with the first gear, the pawls propelled along the engagement tracks by the rotation of the dynamic handle;

wherein rotation of the dynamic handle towards the stationary handle in a first clockwise or counter-clockwise direction causes, as a result of engagement between the first gear and one of the two pawls, rotation of the first gear and the drive gear in the first clockwise or counter-clockwise direction, and wherein rotation of the biased dynamic handle away from the stationary handle results in the engaged pawl to slide or ratchet along the first gear without causing the first gear to rotate.

10. A ratchet wrench comprising:

a housing having spaced apart walls rotatably supporting first, second, and drive toothed gears at respective first, second and drive gear shafts, the first gear enmeshed with the second gear, the second gear enmeshed with the drive gear, the drive gear adapted for driving a rotary fastener;

a fixed handle fixedly attached to the housing;

a rotatable handle rotatably attached to the housing and movable between a first open position, distant from and on a first side of the fixed handle, and a closed position proximate the fixed handle, and wherein the rotatable handle is further rotatable past the fixed handle to a second open position, distant from and on a second side of the fixed handle;

a first pawl pivotally attached to the rotatable handle and having a first pawl tooth in driving engagement with the first toothed gear when the rotatable handle is rotated from the first open position towards the closed position, and wherein the first pawl tooth is in sliding engagement with the first toothed gear when the rotatable handle is rotated away from the closed position and towards the first open position;

a second pawl pivotally attached to the rotatable handle and having a second pawl tooth in driving engagement with the first toothed gear when the rotatable handle is rotated from the second open position towards the closed position, and wherein the second pawl tooth is in sliding engagement with the first toothed gear when the rotatable handle is rotated away from the closed position and towards the second open position;

wherein the first pawl is forced into disengagement from the first toothed gear when the rotatable handle is moved to the second side of the fixed handle, and wherein the second pawl is forced into disengagement from the first toothed gear when the rotatable handle is moved to the first side of the fixed handle; and the housing further comprising a first engagement track slidably receiving a lateral projection extending from the first pawl, the engagement track forcing the lateral projection of the first pawl radially outward, thereby disengaging the first pawl tooth from the first toothed gear.

11. The ratchet wrench of claim 10, the housing further comprising a second engagement track slidably receiving a lateral projection extending from the second pawl, the engagement track forcing the lateral projection of the second pawl radially outward, thereby disengaging the second pawl tooth from the first toothed gear.

12. The ratchet wrench of claim 11, wherein the first and second engagement tracks are defined on opposite spaced-apart walls of the housing.

13. The ratchet wrench of claim 10, wherein the second toothed gear is a compound gear defining a smaller diameter inner gear and a larger diameter outer gear, and wherein the inner gear meshes with the first toothed gear, and wherein the outer gear meshes with the drive gear.

14. The ratchet wrench of claim 10, wherein the rotatable handle is biased away from the fixed handle.

15. The ratchet wrench of claim 10, wherein the rotatable handle is biased away from the fixed handle in a first direction when the rotatable handle is on the first side of the fixed handle and in a second direction when the rotatable handle is on the second side of the fixed handle.

16. The ratchet wrench of claim 10, wherein the first toothed gear comprises a complete gear having teeth along a 360 degree perimeter.

* * * * *